US006238032B1

(12) United States Patent
Cooper et al.

(10) Patent No.: US 6,238,032 B1
(45) Date of Patent: May 29, 2001

(54) REFRIGERATED CABINET WITH MOLDED LINER

(75) Inventors: Johnie J. Cooper, Montgomery, AL (US); Michael J. Palladino, Hamilton, NJ (US)

(73) Assignee: Victory Refrigeration Company, Cherry Hill, NJ (US)

( * ) Notice: Subject to any disclaimer, the term of this patent is extended or adjusted under 35 U.S.C. 154(b) by 0 days.

(21) Appl. No.: 09/316,824

(22) Filed: May 21, 1999

(51) Int. Cl.[7] ..... A47B 57/08

(52) U.S. Cl. ..... 312/401; 312/351; 211/187

(58) Field of Search ..... 312/400, 401, 312/406, 408, 116, 118, 126, 128, 228, 337, 351, 410; 211/187; 108/106, 107, 109, 110, 147.11

(56) References Cited

U.S. PATENT DOCUMENTS 2,604,375 * 7/1952 Beckett ..... 312/351 X
2,672,029 * 3/1954 Saunders ..... 312/116 X
3,301,622 * 1/1967 Dasovic et al. ..... 312/351 X
3,915,097 * 10/1975 Young, Jr. ..... 211/187
4,977,754 * 12/1990 Upton et al. ..... 312/116 X
5,097,673 * 3/1992 Negishi ..... 312/118
5,884,567 * 3/1999 Bartz, Jr. ..... 108/106
5,893,620 * 4/1999 Birgelis ..... 312/351 X

* cited by examiner

*Primary Examiner*—Peter M. Cuomo
*Assistant Examiner*—Michael J. Fisher
(74) *Attorney, Agent, or Firm*—Coats & Bennett, PLLC

(57) ABSTRACT

A refrigerated cabinet with adjustable shelves includes a cabinet having a molded plastic liner defining a refrigeration compartment. A plurality of shelves are disposed in the refrigeration compartment. Shelf supports are integrally molded with the liner to support said plurality of shelves in both horizontal and tilted positions. Integrally formed back stops define channels for air to flow vertically through the cabinet and help lock the shelves in place to prevent accidental dislodging. The liner also defines a housing for the evaporator coil and fan in the upper portion of the liner. Shoulders are integrally formed along the top corners of the liner. The fan panel mounts to the shoulders on opposing sides of the liner and serves as the bottom of the evaporator housing.

13 Claims, 6 Drawing Sheets

REFRIGERATED CABINET WITH MOLDED LINER

FIELD OF THE INVENTION

This invention relates generally to refrigerators and freezers and more particularly to a novel construction for a refrigerated cabinet.

BACKGROUND OF THE INVENTION

A merchandiser is a special purpose refrigerator that is used to display food and beverage products. The merchandiser has a clear door so that the product kept in the merchandiser is visible to shoppers. Typically, the merchandiser is placed in a highly trafficked location in the store, such as the check-out line or adjacent the end of an aisle.

A conventional merchandiser includes a metal exterior housing and a metal liner with a layer of insulating material in the space between the exterior housing and the liner. The merchandiser is loaded through the front much like a conventional stand-up refrigerator. A door with a clear panel is attached by a hinge to the front of the exterior housing. The product is supported by shelves that are attached to the side walls of the liner. In many merchandisers, the spacing between the shelves is fixed.

One drawback to a conventional merchandiser is that the metal liner is relatively expensive and time consuming to fabricate. Numerous bending, stamping, assembling, fastening, and sealing operations are required to form the liner which must then be assembled into the housing. Once the liner is formed and inserted into the housing, additional labor is involved in attaching shelf supports, such as shelf clips or brackets, to the liner. Also, additional labor is required to assemble mounting brackets for the evaporator coil and fan the evaporator coil and fan. Significant savings in fabrication and assembly costs could be realized by simplifying the construction of the liner, shelf support parts, and mounting brackets.

Another disadvantage of the conventional merchandiser is the lack of flexibility in the positioning of shelves. Since beverages and other products come in many different sizes it is desirable to have the ability to move the shelves easily, without having to also move and locate shelf clips or brackets, to accommodate products of different sizes. It is also desirable to have the ability to tilt the shelf downwardly toward the front of the cabinet to gravity feed product to the front of the shelf. These features would allow the operator to store and/or display different products at different times.

Another problem with a conventional merchandiser is that the liner usually fits only a single model of refrigerator. Thus, it is necessary to fabricate and stock many different parts and liners for the various refrigerators that are sold by the manufacturer. Production costs could be further reduced by designing a liner that can be used interchangeably in multiple refrigerators.

Another problem concerns overstocking. When the merchandiser is completely filled, the product contained in the merchandiser may be pushed against the walls of the merchandiser and interfere with the flow of cooling air inside the merchandiser. Consequently, the product in the merchandiser will not be cooled uniformly.

Another problem with conventional metal liners made of sheet metal is that air circulating within the cabinet does not flow smoothly around the corners, which are typically perpendicular. More efficient and uniform cooling could be achieved by using a liner having radiused corners. In liners made of sheet metal, adding a radius involves additional rolling and forming operations that would significantly increase the cost of the refrigerator.

SUMMARY OF THE INVENTION

The present invention relates to a refrigerated cabinet having a molded liner. The molded liner includes integral shelf supports to eliminate the need for shelf clips or brackets. In each of the rear corners of the liner is a vertical column of support ledges that project into the refrigeration compartment. Curved channels are formed along the front edges of the liner. The back edge of the shelves rest on respective shelf supports. A cross-member on the shelf engages the curved channels in the front of the liner to support the front of the shelf. The channel is shaped to prevent forward movement of the shelf once it is put into place. Integrally formed back stops prevent the product from blocking air flow and help lock the shelf in place to prevent accidental dislodging. The liner also defines a housing for the evaporator coil and fan in the upper portion of the cabinet interior. Shoulders are integrally formed along the top corners of the liner. The fan panel mounts to the shoulders on opposing sides of the liner and serves as the bottom of the evaporator housing.

DETAILED DESCRIPTION OF THE PREFERRED EMBODIMENT

Figure 1:
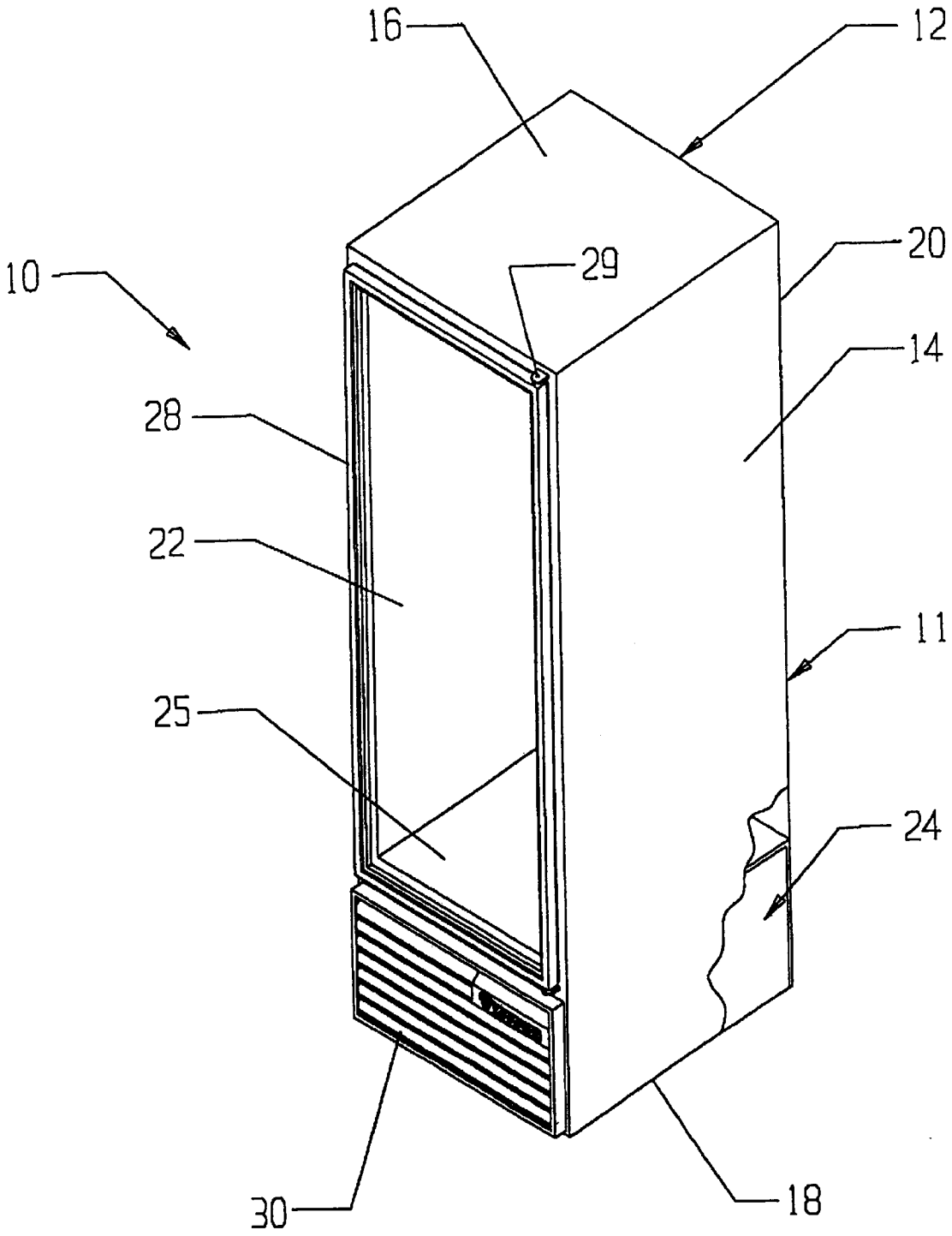
FIG. 1 shows a perspective view of a refrigerated cabinet constructed in accordance with the present invention.

Turning now to the drawings, FIG. 1 shows an exemplary embodiment of a refrigerated cabinet, indicated generally at 10, made in accordance with the present invention. The refrigerated cabinet 10 may be any type of conventional front loading refrigerator or freezer. The particular embodiment shown in the Figures is a freestanding beverage merchandiser for displaying beverages in retail outlets. The present invention, however, may also be used in a food storage refrigerator or freezer. The invention may also have application in refrigerated cabinets used in industries other than food and beverage industry.

The refrigerator 10 generally includes a cabinet 11 that defines a refrigeration compartment, a plurality of shelves 70 disposed within the refrigeration compartment, and a refrigeration system 80 for cooling the refrigeration compartment. The cabinet 11 includes an outer housing 12 and a liner 40 that is disposed inside the outer housing. In the disclosed embodiment, the outer housing 12 is made of sheet metal that is formed into a generally rectangular box in a conventional fashion. The liner 40 is preferably molded from a plastic material such as polyethylene or polyurethane. As will be hereinafter described, the liner 40 includes integrally molded features that serve as supports for the shelves 70, that space the product on display away from the walls of the liner 40 and define vertically extending air flow channels, and define a fan compartment in the upper portion of the refrigeration compartment that houses the evaporator coil and fan. These and other features of the liner 40 are described in more detail below.

The outer housing 12 includes sides 14, a top wall 16, a bottom wall 18, and a rear wall 20. The housing 12 is open at the front. The interior of the housing 12 is divided by a partition 25 into an upper compartment 22 and a lower compartment 24. The upper compartment 22 is where the product is stored and will be referred to as the refrigeration compartment 22. The lower compartment 24 is where the compressor, condenser, and other components of the refrigeration system are housed and will be referred to as the compressor compartment 24.

An inwardly projecting flange 26 is formed at the forward edge of the side walls 14, the top wall 16, and the bottom wall 18. The flange 26 surrounds the front opening 50 of the housing 12. A door 28 is mounted by means of hinges 29 to the flange 26 along one of the side walls 14. The door 28 provides access to the refrigeration compartment 22. In the embodiment shown, the door 28 comprises a frame holding a clear panel so that the product inside the merchandiser 10 is visible to a passersby. A solid, insulated door could also be used. A grill 30 covers the open front of the compressor compartment 24. The grill 30 is preferably removable to allow repairs to be made to the refrigeration system.

Figure 2:
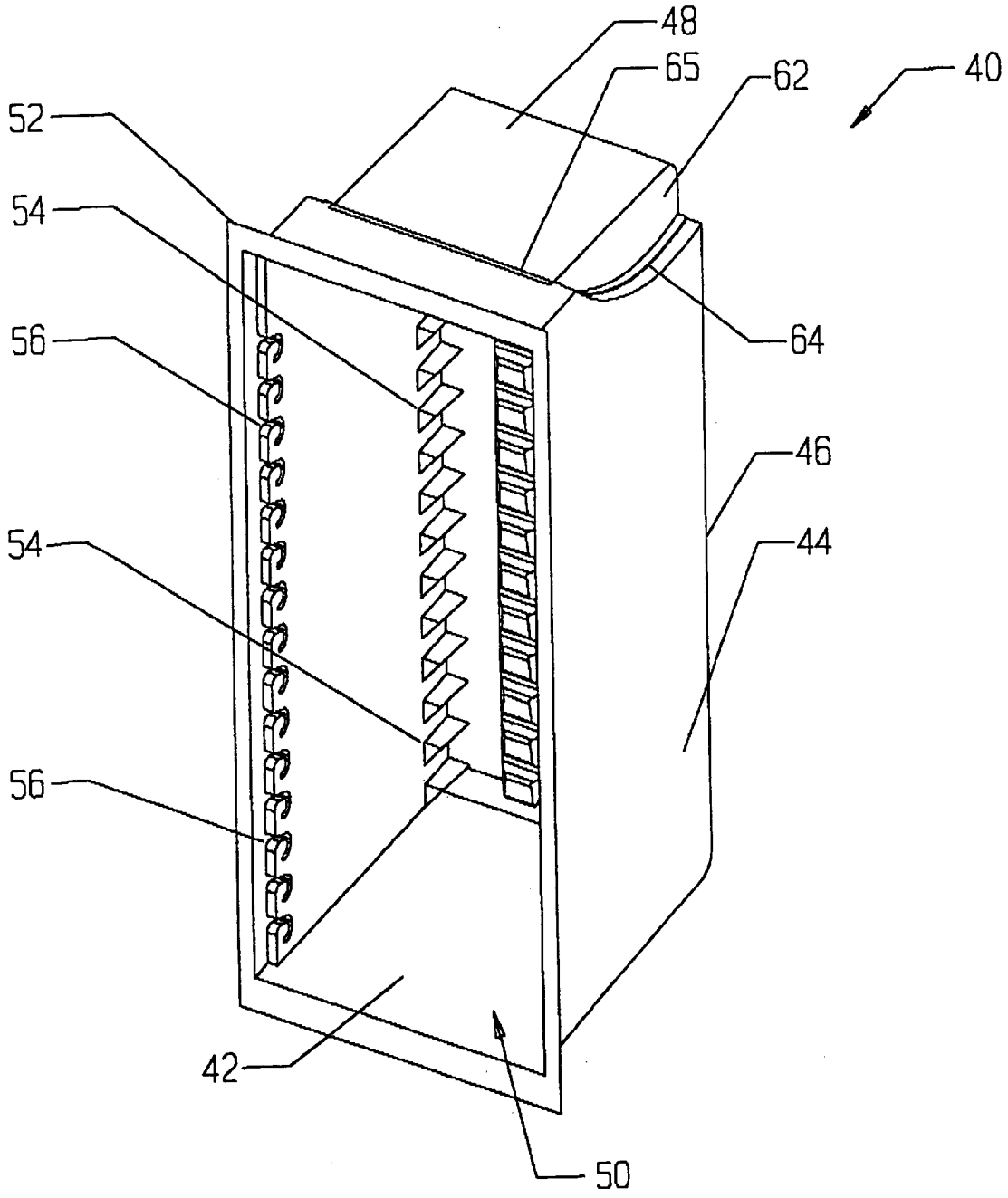
FIG. 2 illustrates a perspective view of the liner used in the refrigerated cabinet.
Figure 3:
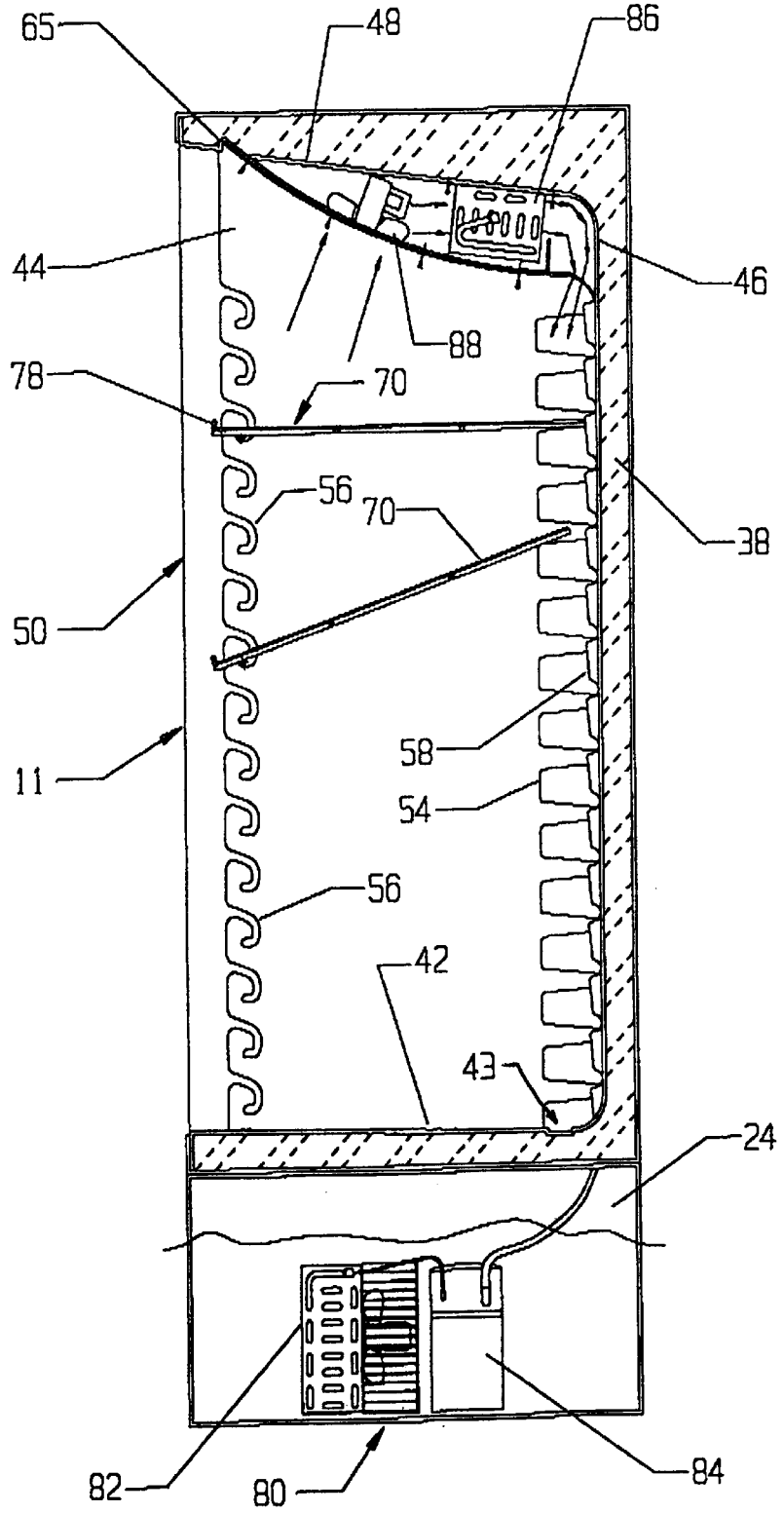
FIG. 3 is a vertical cross-section of the refrigerated cabinet, with a shelf inserted for illustration purposes.
Figure 4:
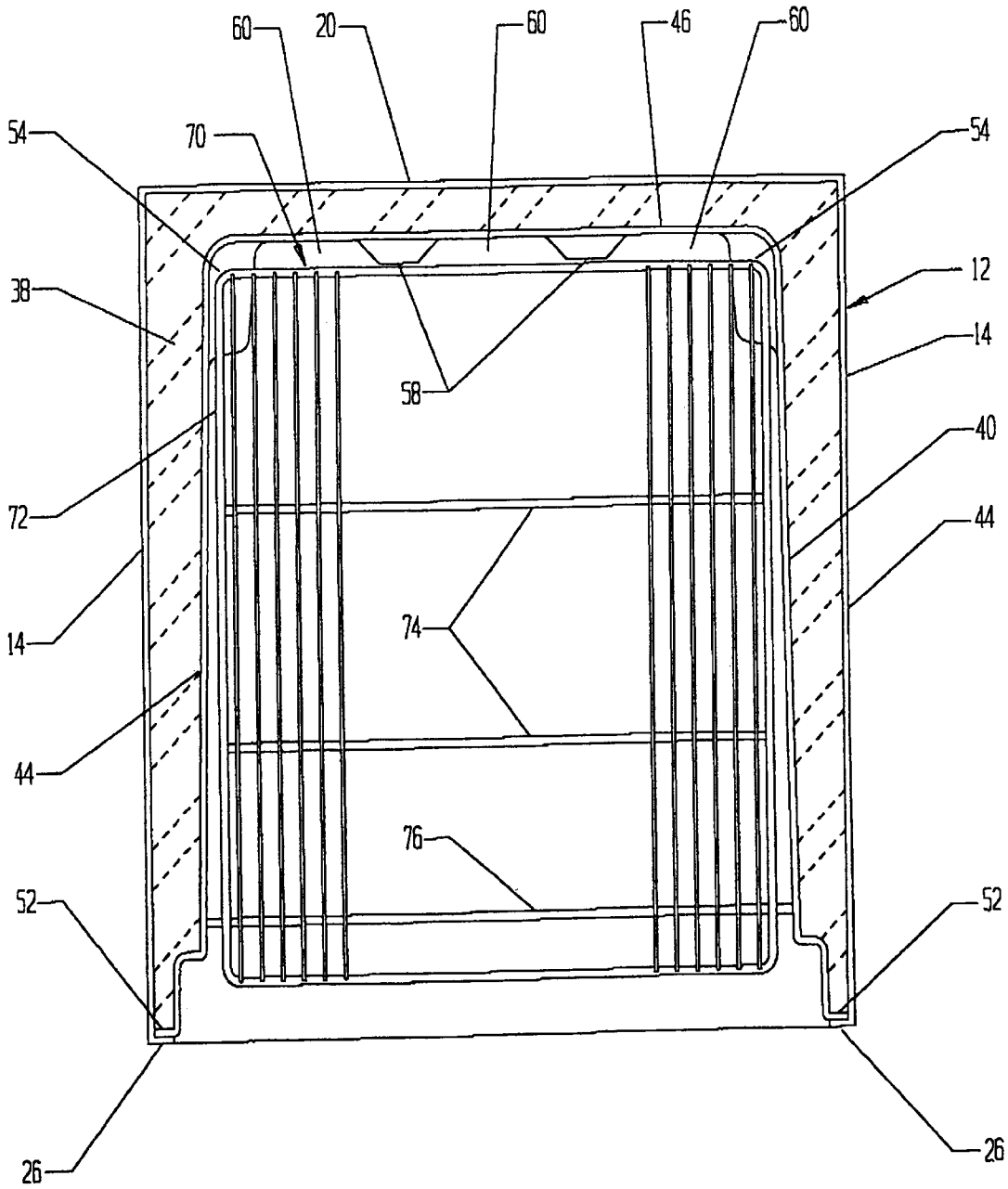
FIG. 4 features a horizontal cross-section of the refrigerated cabinet.

The liner 40, better seen in FIGS. 2–4, is preferably formed from one piece of molded plastic, and is sized and shaped to fit inside the refrigeration compartment 22. Those skilled in the art will recognize that the liner 40 could be molded in two or more parts. The liner 40 includes a bottom 42, side walls 44, a back wall 46, and a top 48. The liner 40 has an open front 50 which is surrounded by an outwardly projecting flange 52. The liner 40 is inserted into the housing 12 so that the flange 26 of the housing 12 overlaps the flange 52 of the liner 40 as best seen in FIG. 4. Thus, the housing flange 26 helps hold the liner 40 in the housing 12. After the liner 40 is inserted into the housing 12, the space between the liner 40 and the walls of the housing 12 is filled with a foam material 38 that both insulates the refrigeration compartment 22 and helps hold the liner 40 in place. Preferably, the foam 38 is sprayed into the insulating space between the liner 40 and the walls of the housing 12. Foam blocks (not shown) may be used to temporarily position and hold the liner 40 while the foam 38 is sprayed into the insulating space. If desired, the liner 40 may be further secured by use of screws (not shown) that pass through the flange 26 of the housing 12 and the flange 52 of the liner 40. Other forms of fasteners besides screws could also be used. The use of screws or other fasteners, however, is not necessary since the foam 38 surrounding the liner 40 in combination with the flange 26 on the housing 12 is sufficient to hold the liner 40 in place.

One or more removable and adjustable shelves 70 are supported inside the liner 40. The function of the shelves 70 is to support the product in storage or on display. The shelves 70 comprise a generally rectangular wire frame 72 with a series of cross members 74, 76. The ends of the forward-most cross member 76 extend outward from opposing sides of the shelf 70. The forward-most cross member 76 serves to support the shelf 70 as will be described below. A stop 78 is formed along the forward edge of the shelves 70 to prevent product from slipping off the front of the shelves 70. The stop 78 is needed when the shelves 70 are placed in a tilted position as will be described below.

The liner 40 includes integrally molded shelf supports, such as ledges and channels, to support the product shelves 70. More specifically, a series of support ledges 54 are integrally molded at the rear corners of the liner 40 at the intersection of the back wall 46 with each of the side walls 44. In the disclosed embodiment, the support ledges 54 have a generally triangular configuration and project into the refrigeration compartment 22. Alternately, the support ledges 54 could be recessed into the walls of the liner 40 rather than projecting into the refrigeration compartment. The support ledges 54 are arranged in two vertical columns or arrays. The support ledges 54 support the back edge of the product shelves 70.

A series of curved channels 56 are formed in the liner 40 along the forward edges of the side walls 44. The curved channels 56 have an opening at the front to allow the ends of cross-member 76 to be inserted into the channel 56. The channels extend from the forward edge of the side walls 44 toward the rear and then curve downwardly. The terminal ends of the channels curve downwardly and forwardly. The curved channels 56 engage the ends of cross members 76 to support the front of the shelves 70.

As shown in FIG. 3, the shelf 70 is placed in the liner 40 so that the back edge of the shelf 70 rests one a pair of the support ledges 54. As the shelf 70 is pushed back into the liner 40, the ends of the cross member 76 are engaged in a selected pair of the curved channels 56. The cross member 76 slides down the channel 56 into the terminal end of the channel 56 as the shelf 70 is pushed back. The form of the curved channels 56 is such that the weight of the product on the shelf 70 will hold the shelf 70 in place and forward movement of the shelf 70 will be prevented unless the shelf 70 is lifted. As shown in FIG. 3, the shelf 70 may be positioned in either a horizontal or tilted position. Tilting may be desired to gravity feed merchandise from the back towards the front as product is removed from the merchandiser 10.

A series of vertically spaced back stops 58 are integrally molded in the rear wall of the liner 40. The back stops 58 are arranged in two or more laterally spaced, vertical columns between the support ledges 54. The spaces between the vertical columns of back stops 58 and support ledges 54 serve as air flow channels, which are designated by the numeral 60. The air flow channels 60 provide a channel for air to circulate vertically to promote even cooling within the refrigerated compartment. The back stops 58 bear against the back edge of the shelf 70 and help lock the shelf 70 in place. To remove a shelf 70, the back edge of the shelf 70 is lifted to allow the shelf to slide back into the space between the vertically spaced back stops 58. After the shelf 70 is slid back, the front edge can be lifted out of the channels 56.

Figure 6:
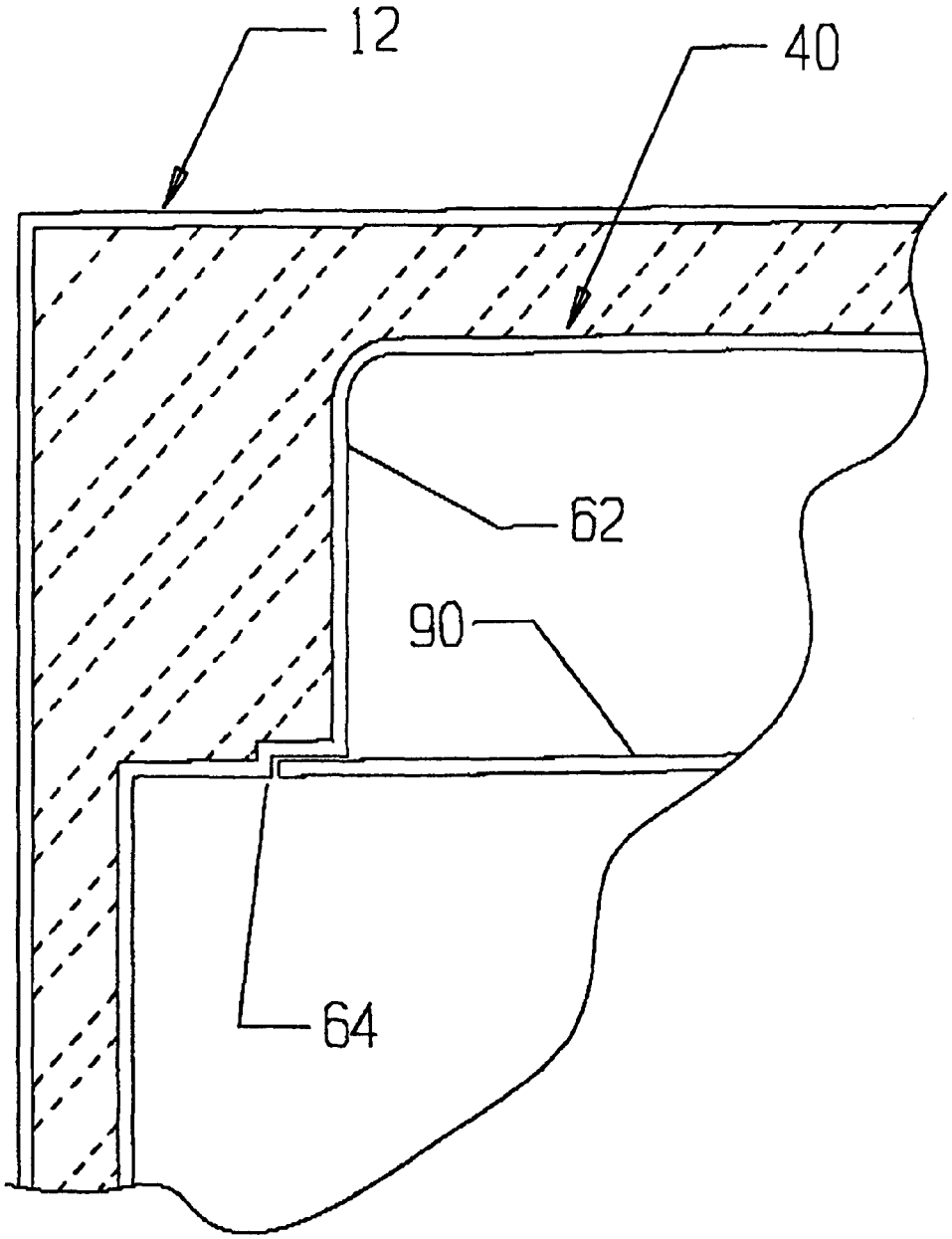
FIG. 6 is a partial cross-section of the refrigerated cabinet showing the shoulder in the upper portion of the liner.

Shoulders 62, shown best in FIGS. 2 and 6, are formed at the upper corners of the liner 40. Shoulders 62 are gently curved and slope away from the flange 52 towards rear wall. The space between the shoulders 62 defines a fan compartment for the evaporator coil 86 and fan, which form a part of the refrigeration system 80. The evaporator coil 80 is mounted to the top wall of the liner 40. The fan 88 is attached to a fan panel 90 that is fastened to the shoulders 62. The shoulders include a groove 65 that receives fan panel 90 as seen best in FIG. 6. Fan panel 90 is held in place by fasteners spaced along lateral edges of the fan panel 90. The front edge of the fan panel 90 is received in a groove 65 formed in the top of the liner 40. The groove 65 conceals the edge of the fan panel 90 without the need for additional trim and provides a seal. The fan panel 90 includes an inlet opening through which air is drawn into the mechanical compartment. Air is discharged through a discharge opening between the rear edge of the fan panel 90 and the rear wall of the liner 40.

Floor of the liner 40 slopes toward rear wall to direct spillage to a drain recess 43 integrally formed along the back wall of the liner.

The refrigeration system, indicated generally by the numeral 80, is the same as a conventional refrigerated cabinet. The refrigeration system 80 includes a compressor 82, a condenser 84, and an evaporator 86. The compressor 82 pumps a refrigerant gas through the condenser 84 where the refrigerant gas liquefies and loses heat. The cooled, liquid refrigerant is then circulated through the evaporator 86 where it absorbs heat from the surrounding air and vaporizes. A fan 88 draws air through the evaporator 86 to cool the air and circulate the cooled air in the refrigeration compartment. The refrigerant gas returns back to the compressor 82 where the process is repeated. In the disclosed embodiment, the compressor 82 and condenser 84 are disposed in the lower compartment 24 at the bottom of the refrigerated cabinet 10. The evaporator 86, as already described is disposed in the fan compartment in the upper portion of the refrigerated compartment 22. This particular arrangement of components is not an important aspect of the invention. Those skilled in the art will recognize that the components could be arranged in many other ways.

Figure 5:
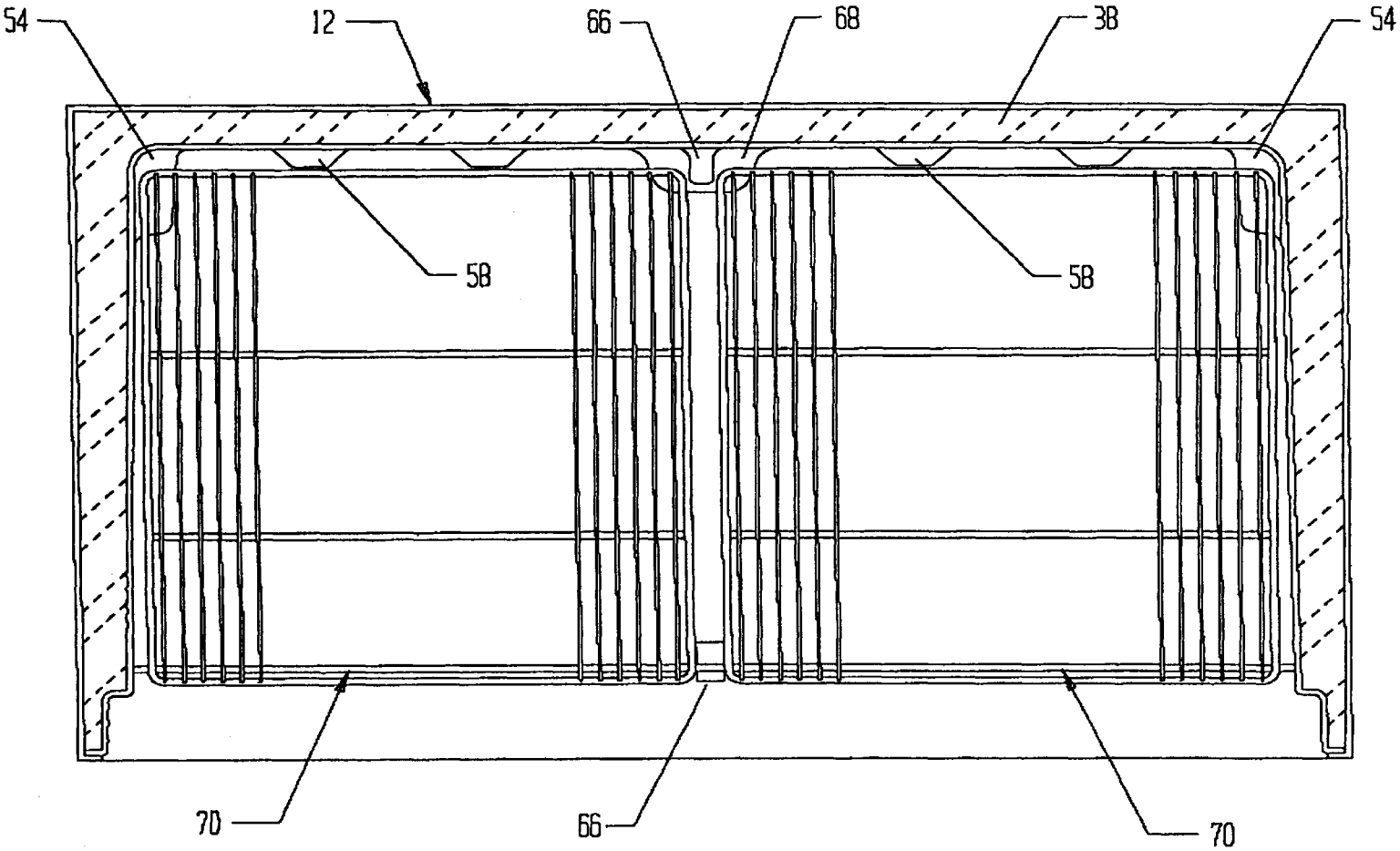
FIG. 5 is a cross-section showing an alternate embodiment of the refrigerated cabinet.

FIG. 5 shows an alternate embodiment of the present invention adapted for a double-wide refrigerated cabinet 10. In this embodiment, liner 40 includes support ledges 54, back stops 58, shoulders 62 as described in the first embodiment. The liner 40 in this embodiment further includes vertical support column 66 disposed at the center of the rear wall 46 and at the center of the front opening 50. A series of central support ledges 68 are formed around the rear vertical support column 66 to support inner corners of adjacent shelves 70. Front vertical support column 66 may include channels 56 as previously described to support the interior front corners of the shelves 70. The channels could be formed on either side of the front column 66. Alternatively, the front support column 66 could use brackets as hooks to support the ends of the cross member 76 of the shelves 70.

The present invention may, of course, be carried out in other specific ways than those herein set forth without departing from the spirit and essential characteristics of the invention. The present embodiments are, therefore, to be considered in all respects as illustrative and not restrictive, and all changes coming within the meaning and equivalency range of the appended claims are intended to be embraced therein.

What is claimed is:

1. A refrigerated cabinet comprising:

a) an outer housing;

b) a liner positioned within said outer housing, said liner including a back wall and a pair of side walls;

c) at least one shelf disposed within said liner, said shelf including a pair of laterally projecting support members;

d) a plurality of support ledges integrally formed along the back wall of the liner for supporting a back portion of the shelf;

e) a plurality of channels integrally formed in the side walls of said liner for supporting a front portion of said shelf, wherein said channels are engaged by the support members of the shelf;

f) wherein said at least one shelf can be supported in a plurality of horizontal and tilted positions by engaging the shelves with selected support ledges and channels;

g) a pair of laterally spaced opposing shoulders extending down from the top of said liner, and wherein said shoulders define a fan compartment in an upper portion of the liner; and h) a fan panel attached to shoulder to enclose the fan compartment, said fan panel slidably positioned in a front groove formed in the top of the liner.

2. The refrigerated cabinet of claim 1 wherein said liner includes a floor having an integrally formed drain channel, and wherein said floor slopes toward said drain channel.

3. The refrigerated cabinet of claim 1 wherein said support ledges are arranged in two columns in the corners formed by said back wall and said side walls.

4. The refrigerated cabinet of claim 1 wherein said channels are shaped to prevent forward movement of the shelves when the support members are engaged with the channel.

5. The refrigerated cabinet of claim 4 wherein the channels extend from a forward edge of the side walls and include an opening to allow insertion of the support members into the channel.

6. The refrigerated cabinet of claim 5 wherein the channels include a terminal end that curves downwardly and forwardly in a generally j-shaped configuration.

7. A liner for a refrigerated cabinet having adjustable shelves, said liner comprising:

a) a back wall;

b) a pair of side walls joining the back wall at rear vertical corners of the liner;

c) a top wall joining the side walls and back wall at upper corners of the liner;

d) a bottom wall joining the side walls and back wall at lower corners of the liner;

e) a plurality of vertically spaced support ledges integrally formed along the back wall of the liner for supporting a back portion of the shelves, wherein said shelves independently rest on different top surfaces of different ones of said respective support ledges;

f) a plurality of vertically spaced channels integrally formed in the side walls of said liner and engaged by said shelves for supporting a front portion of said shelves;

g) wherein said different ones of said shelves can be independently supported in a plurality of horizontal and tilted positions by engaging the shelves with selected support ledges and channels;

h) a pair of laterally spaced opposing shoulders extending down from the top of said liner, and wherein said shoulders define a fan compartment in an upper portion of the liner: and i) a fan panel attached to shoulder to enclose the fan compartment, said fan panel slidably positioned in a front groove formed in the top of the liner.

8. The liner of claim 7 wherein said support ledges are arranged in two columns in the rear corners of said liner.

9. The liner of claim 7 wherein said channels are shaped to prevent forward movement of the shelves when the shelves are engaged with the channels.

10. The liner of claim 9 wherein the channels extend from a forward edge of the side walls and include an opening to allow insertion of the shelves into said channels.

11. The liner of claim 10 wherein the channels include a terminal end that curves downwardly and forwardly in a generally j-shaped configuration.

12. The cabinet of claim 7 wherein said liner includes a floor having an integrally formed drain channel, and wherein said floor slopes toward said drain channel.

13. A refrigerated cabinet with adjustable shelves, comprising:

a) a cabinet having a unitary, integral molded plastic liner defining a refrigeration compartment, said liner having a top, three vertical sides joined to said top, said sides including a rear side and two opposing sides joined to said rear side at opposing rear corners, and a bottom joined to said sides, said bottom defining a drain recess proximate a rear corner of said bottom, said top, bottom, and two opposing sides defining a front lip for securing said liner to said cabinet;

b) a plurality of shelves disposed in said refrigeration compartment;

c) support means for supporting said plurality of shelves in a plurality of horizontal and tilted positions, said shelves independently positionable in said plurality of horizontal and tilted positions;

d) a pair of laterally spaced opposing shoulders extending down from the top of said liner, said shoulders defining a fan compartment in an upper portion of the liner;

e) a fan panel attached to shoulder to enclose the fan compartment, said fan panel slidably positioned in a front groove formed in the top of the liner; and f) a plurality of vertically arranged rear spacers for spacing each of said plurality of shelves from said rear side such that air may circulate freely between said rear spacers.

* * * * *